US008127497B2

(12) United States Patent
Rogers et al.

(10) Patent No.: US 8,127,497 B2
(45) Date of Patent: Mar. 6, 2012

(54) APPARATUS AND METHOD FOR PROVIDING A SLIDING DOOR MECHANISM

(75) Inventors: Lloyd W. Rogers, Washington Township, MI (US); David W. Whitehead, Rochester Hills, MI (US); Lawrence Easton, Walled Lake, MI (US)

(73) Assignee: Strattec Power Access LLC, Glendale, WI (US)

( * ) Notice: Subject to any disclaimer, the term of this patent is extended or adjusted under 35 U.S.C. 154(b) by 637 days.

(21) Appl. No.: 11/860,806

(22) Filed: Sep. 25, 2007

(65) Prior Publication Data

US 2008/0072498 A1 Mar. 27, 2008

Related U.S. Application Data

(60) Provisional application No. 60/826,989, filed on Sep. 26, 2006.

(51) Int. Cl.
*E05F 11/00* (2006.01)

(52) U.S. Cl. ..... 49/360; 296/155

(58) Field of Classification Search ..... 49/360; 296/155

See application file for complete search history.

(56) References Cited

U.S. PATENT DOCUMENTS

| | | | |
|---|---|---|---|
| 4,862,640 | A | 9/1989 | Boyko et al. |
| 4,887,390 | A | 12/1989 | Boyko et al. |
| 5,046,283 | A | 9/1991 | Compeau et al. |
| 5,138,795 | A | 8/1992 | Compeau et al. |
| 5,189,839 | A | 3/1993 | Deland et al. |
| 5,263,762 | A | 11/1993 | Long et al. |
| 5,319,880 | A | 6/1994 | Kuhlman |
| 5,319,881 | A | 6/1994 | Kuhlman |
| 5,323,570 | A | 6/1994 | Kuhlman et al. |
| 5,350,986 | A | 9/1994 | Long et al. |
| 5,396,158 | A | 3/1995 | Long et al. |
| 5,434,487 | A | 7/1995 | Long et al. |

(Continued)

FOREIGN PATENT DOCUMENTS

| | | |
|---|---|---|
| DE | 10256181 | 1/2004 |

(Continued)

OTHER PUBLICATIONS

PCT International Search Report dated Apr. 1, 2008.

(Continued)

*Primary Examiner* — Jerry Redman

(74) *Attorney, Agent, or Firm* — Michael Best & Friedrich LLP

(57) ABSTRACT

A drive assembly for a sliding door is disclosed, the drive assembly having a power drive unit for providing a rotational force to rotate a cable drum of the drive assembly, the power drive unit being mounted within the sliding door; a cable having one end secured a guide track of the drive assembly and another end secured to the guide track; a roller assembly configured to slidably engage the guide track; an arm fixedly secured to the sliding door and pivotally mounted to the roller assembly at a pivot point; a pulley rotationally mounted to the roller assembly, the axis of rotation of the pulley being aligned with the pivot point and the cable engages the pulley in opposite directions as the cable drum rotates and the roller assembly slides along the guide track as the cable drum rotates, wherein movement of the roller assembly causes movement of the sliding door.

14 Claims, 10 Drawing Sheets

U.S. PATENT DOCUMENTS

| | | | | |
|---|---|---|---|---|
| 5,536,061 | A | 7/1996 | Moore et al. | |
| 5,809,696 | A * | 9/1998 | Watanabe | 49/360 |
| 5,876,087 | A | 3/1999 | Kleefeldt et al. | |
| 6,247,373 | B1 | 6/2001 | Bree et al. | |
| 6,270,149 | B1 * | 8/2001 | Fukumoto et al. | 296/155 |
| 6,321,488 | B1 | 11/2001 | Bigoszewski et al. | |
| 6,530,619 | B2 | 3/2003 | Fukumoto et al. | |
| 6,659,539 | B2 * | 12/2003 | Yogo et al. | 296/155 |
| 6,802,154 | B1 * | 10/2004 | Holt et al. | 49/26 |
| 6,814,394 | B2 * | 11/2004 | Yogo et al. | 296/155 |
| 6,935,071 | B2 * | 8/2005 | Yokomori et al. | 49/360 |
| 7,093,887 | B2 * | 8/2006 | Mrkovic et al. | 296/155 |
| 7,159,930 | B2 * | 1/2007 | Yokomori et al. | 296/155 |
| 7,243,461 | B2 * | 7/2007 | Rogers et al. | 49/360 |
| 7,354,100 | B2 * | 4/2008 | Yokomori et al. | 296/155 |
| 7,533,926 | B2 * | 5/2009 | Mitsui et al. | 296/155 |
| 7,575,270 | B2 * | 8/2009 | Nagai et al. | 296/155 |
| 2002/0043818 | A1 * | 4/2002 | Fukumoto et al. | 296/155 |
| 2003/0189196 | A1 * | 10/2003 | Kita | 254/225 |
| 2004/0003542 | A1 * | 1/2004 | Shimada et al. | 49/360 |
| 2004/0070231 | A1 * | 4/2004 | Yogo et al. | 296/155 |
| 2004/0221511 | A1 | 11/2004 | Rogers, Jr. et al. | |
| 2005/0044794 | A1 | 3/2005 | Kriese | |
| 2006/0225358 | A1 | 10/2006 | Haag et al. | |

FOREIGN PATENT DOCUMENTS

| | | |
|---|---|---|
| EP | 1380718 | 4/2005 |
| GB | 215691 | 5/1924 |

OTHER PUBLICATIONS

PCT/US2007/079383 International Preliminary Report on Patentability dated Apr. 9, 2009 (6 pages).

* cited by examiner

APPARATUS AND METHOD FOR PROVIDING A SLIDING DOOR MECHANISM

CROSS-REFERENCE TO RELATED APPLICATIONS

This application claims the benefit of U.S. Provisional Patent Application Ser. No. 60/826,989, filed Sep. 26, 2006, the contents of which are incorporated herein by reference thereto.

BACKGROUND

The present application relates to vehicle doors and, more particularly, the present application relates to an apparatus and method for providing a sliding door mechanism.

A typical vehicle is manufactured with a plurality of doors. Each door is typically mounted on hinges within a door opening. Some larger vehicles have sliding doors that slide from an open position to a closed position. Thus egress and ingress of the vehicle is possible without requiring a large open area beside the vehicle to allow for pivoting of the door. This is particularly useful in parking lots where the area between the vehicles is typically not large enough to allow for full pivoting to open the doors. Moreover, such sliding doors also allow the vehicles to have larger door openings.

Accordingly, sliding doors provide access to large door openings without requiring a large area adjacent to the vehicle, which would be required for a door that pivots on its hinge. In one configuration, a power sliding door is supported and guided by an upper track, a center track and a lower track. An upper roller is attached to the power sliding door and travels in the upper track. A lower roller is attached to a lower portion of the sliding door and runs or travels in the lower track. A hinge and roller assembly is pivotally attached to a rear portion (e.g., towards the rear of the vehicle) of the door between the upper and lower portions of the door. The hinge and roller assembly is also received in the track to allow for sliding movement of the door.

In addition to the usage of sliding doors in vehicles, power drive systems have been implemented wherein automatic opening, closing, locking and unlocking of the sliding door is facilitated through a drive system coupled to the sliding door. Presently, some sliding doors are driven through cables attached to the forward and aft sides of the center roller hinge (e.g., a hinge mounted towards the center of the door with respect to the upper and lower edges of the same).

Power sliding door (PSD) units have traditionally been located (in minivans) in the vehicle body between the "C" pillar and the "D" pillar, a.k.a. the rear quarter panel. This packaging area is greatly sought after by original equipment manufactures (OEMs) to locate other items. These items might include rear air conditioning units, spare tires, tool kits for tire changes, or general storage for the vehicle owner.

When quarter panel mounted PSD units are used, OEMs must allow for two different assembly sequences: one for the manual sliding door, and one for the power sliding door. If a door mounted power sliding door unit is used, the impact on the rear quarter panel usage is greatly reduced since door systems are often assembled off line from the main assembly line.

One design for a power sliding door is disclosed in U.S. Pat. No. 4,887,390. As shown in U.S. Pat. No. 4,887,390, an opening and closing device for a sliding vehicle door is provided, wherein a driving mechanism is installed in the sliding vehicle door. The driving mechanism has an output drum and a cable wound by the output drum, wherein one end of the cable is secured to the vehicle body and another end of the cable is secured to the vehicle body. The sliding door shown in U.S. Pat. No. 4,887,390 is slidably supported by a guide rail provided in the vehicle body and the cable is located in the guide rail, wherein one end of the cable is engaged with the vehicle body at one end and the another end of the cable is engaged with the vehicle body at another end.

However, in order to provide the necessary opening and closing forces to the sliding door, the driving mechanism in the sliding door must accommodate for the varying forces required as the door slides along in the guide rail. More particularly, as the door traverses along the guide track, the amount of cable being wrapped up by the cable drum may vary with the amount of cable being wrapped off. In addition, as the door slides along the curved portion of the guide rail (e.g., during initial opening or end of closing) located at either the lower track or center track, a higher force needs to be applied to cables pulling the door along in its guide track. In addition, since the driving mechanism is located within the door, the available real estate for driving mechanism designs is extremely limited.

Accordingly, it is desirable to provide an apparatus and method for providing a sliding door mechanism wherein the mechanism is capable of being installed within the sliding door and provides the necessary opening and closing forces.

SUMMARY OF THE INVENTION

In accordance with an exemplary embodiment, a drive assembly for a sliding door is provided, the drive assembly comprising: a power drive unit for providing a rotational force to rotate a cable drum of the drive assembly, the power drive unit being mounted within the sliding door; a pair of cables each having one end secured to the cable drum and another end secured to a guide track; a roller assembly configured to slidably engage the guide track; an arm fixedly secured to the sliding door and pivotally mounted to the roller assembly at a pivot point; a pulley rotationally mounted to the roller assembly, the axis of rotation of the pulley being aligned with the pivot point and each of the pair of cables engage the pulley in opposite directions as the cable drum rotates and the roller assembly slides along the guide track as the cable drum rotates, wherein movement of the roller assembly causes movement of the sliding door.

In accordance with another exemplary embodiment, a drive assembly for a sliding door is provided, the drive assembly comprising: a power drive unit for providing a rotational force to rotate a cable drum of the drive assembly, the power drive unit being mounted within the sliding door; a cable having one end secured to a guide track of the drive assembly and another end secured to the guide track; a roller assembly configured to slidably engage the guide track; an arm fixedly secured to the sliding door and pivotally mounted to the roller assembly at a pivot point; a pulley rotationally mounted to the roller assembly, the axis of rotation of the pulley being aligned with the pivot point and the cable engages the pulley in opposite directions as the cable drum rotates and the roller assembly slides along the guide track as the cable drum rotates, wherein movement of the roller assembly causes movement of the sliding door.

In accordance with another exemplary embodiment, a method for opening and closing a sliding door of a vehicle is provided, the method comprising: locating a power drive unit of a drive assembly in a cavity of the sliding door, the power drive unit providing a rotational force to a cable drum of the drive assembly; securing a first end of a first cable to the cable drum and securing a second end of the first cable to a first fixed location; securing a first end of a second cable to the cable drum and securing a second end of the second cable to a second fixed location; pivotally mounting an arm to a roller assembly at a pivot point, the roller assembly being configured to slidably engage a guide track, the arm being secured to the sliding door; rotationally mounting a pulley to the roller assembly, the axis of rotation of the pulley being aligned with the pivot point, the first cable and the second cable engage the pulley in opposite directions as the cable drum rotates and the roller assembly slides along the guide track as the cable drum rotates, wherein movement of the roller assembly causes movement of the sliding door.

DETAILED DESCRIPTION OF EXEMPLARY EMBODIMENTS

Figure 1:
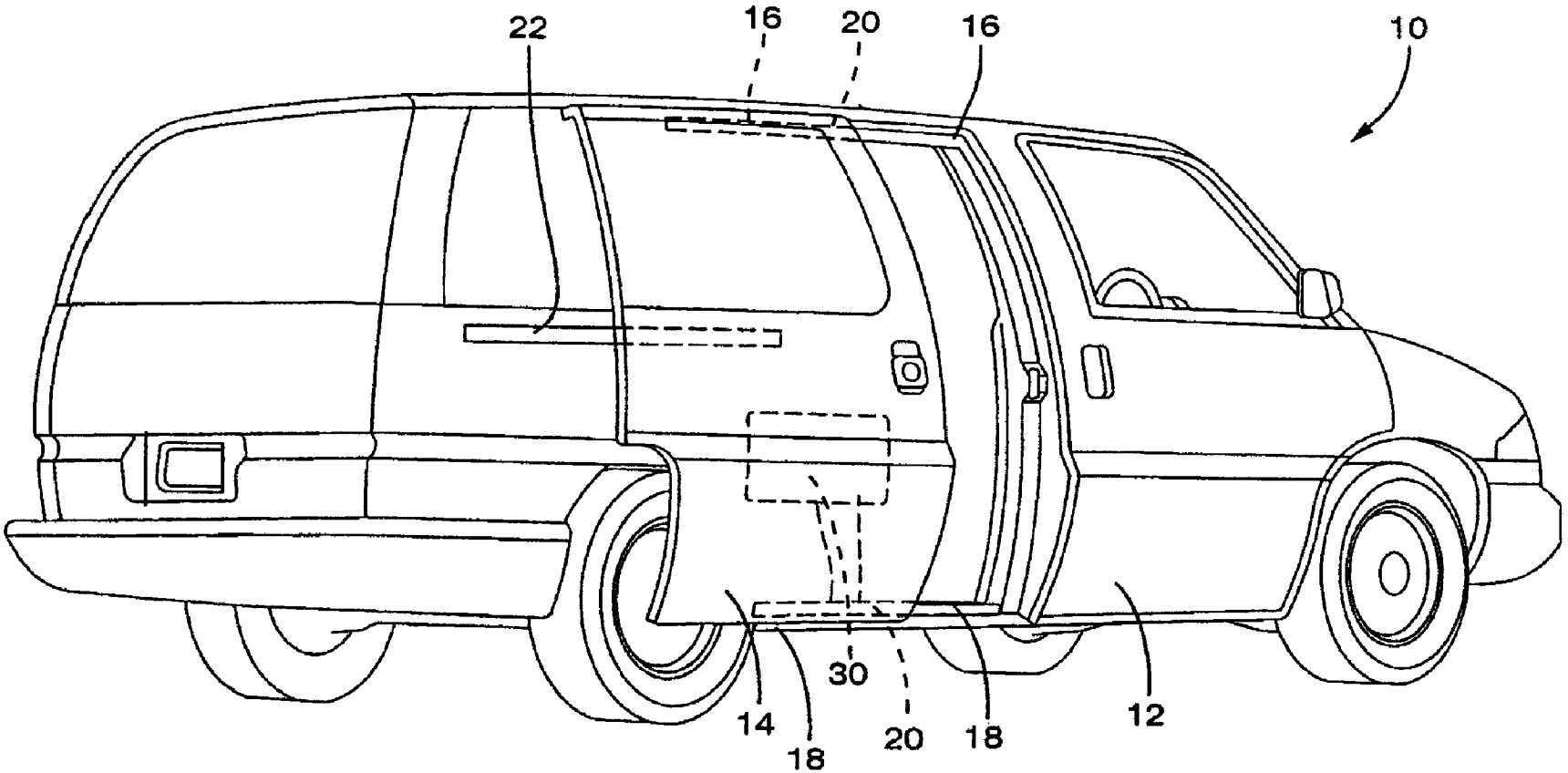
FIG. 1 is a perspective view of a power sliding door drive assembly.

Exemplary embodiments of the present invention relate to an apparatus and method for providing a drive unit that is installed within a sliding door of a vehicle.

Prior apparatus and methods for providing and/or effectuating moving of a sliding door of a vehicle are found in U.S. Pat. Nos. 5,046,283; 5,138,795; 5,319,880; 5,319,881 and 5,323,570, the contents of which are incorporated herein by reference thereto.

Reference is also made to U.S. patent application Ser. No. 10/798,733, filed Mar. 11, 2004, the contents of which are incorporated herein by reference thereto. EP 1380718, and its related parent or priority applications GB 215691 and DE 10256181, the contents of which are each incorporated herein by reference thereto, also illustrate an in-door mounted power sliding door system.

Exemplary embodiments of the present invention relate to an in-door power sliding door unit that operates on the lower track of a sliding door. In accordance with an exemplary embodiment, the power door unit, except for a portion of the driving cables, the cable tensioners and the roller assembly, is mounted within a cavity of the sliding door.

U.S. patent application Ser. No. 10/798,733 relates to a rocker panel mounted power sliding door module that addresses the packaging issues mentioned above since it is located in a less sought after area and has less impact on assembly processes since it is modular in design. However, the rocker panel mounted design requires knowledge of the vehicle body design, which may require collaboration with the original equipment manufacturer since the rocker panel design may have an impact on the body-in-white design. As used herein, the term body-in-white refers to the body shell of a vehicle, which is the skeletal structure to which various subsystems are subsequently attached, such as the engine and drive train, suspension and wheels, interior components, and exterior body components, such as the doors, hood and trunk lid.

In accordance with an exemplary embodiment of the present invention, the in-door power sliding door unit allows original equipment manufactures (OEMs) to use quarter panel space for other items, has minimal impact on vehicle assembly, and can be implemented later in the vehicle development process. In addition, the mounting position of the drive unit itself is very flexible, allowing the designer more freedom for a given application.

In addition, the appearance of the unit is very acceptable since the pulleys mount on top of the lower control arm very low in the door and are covered. Moreover, the cables are only visible if the viewer's eyes are at a level equal to the lower track, which is several inches above the ground. Finally, the cables themselves have only very limited motion relative to the track, which also improves on cable wear.

In addition, tensioners for the cable(s) have been incorporated into cable end mounts, which snap into position on the lower guide channel, which is already in place on the vehicle. The cable end mounts provide fixed mounting locations for the cable ends. This greatly simplifies assembly and represents the only mechanical interface between the cables and the vehicle. In one embodiment, both tensioners snap into place. In another embodiment, only one tensioner is snapped into place and the other tensioner is secured into place via any suitable means for securement, such as screws, etc. In yet another alternative embodiment, both tensioners are initially snapped into place and then they are permanently secured via any suitable means for securement, such as screws, bolts, etc.

Referring now to FIG. 1, a vehicle 10 with a front pivoting door 12 and a power sliding door 14 is illustrated. Here, power sliding door 14 is guided by rollers that are slidably received in an upper guide track 16 and a lower guide track 18. The rollers 20 are configured to be received in upper guide track 16 and lower guide track 18. In addition to upper guide track 16 and lower guide track 18, a center guide track 22 may also be provided. Center guide track 22 is also configured to receive and engage a roller that is coupled to sliding door 14 proximate to the center guide track.

Figure 2:
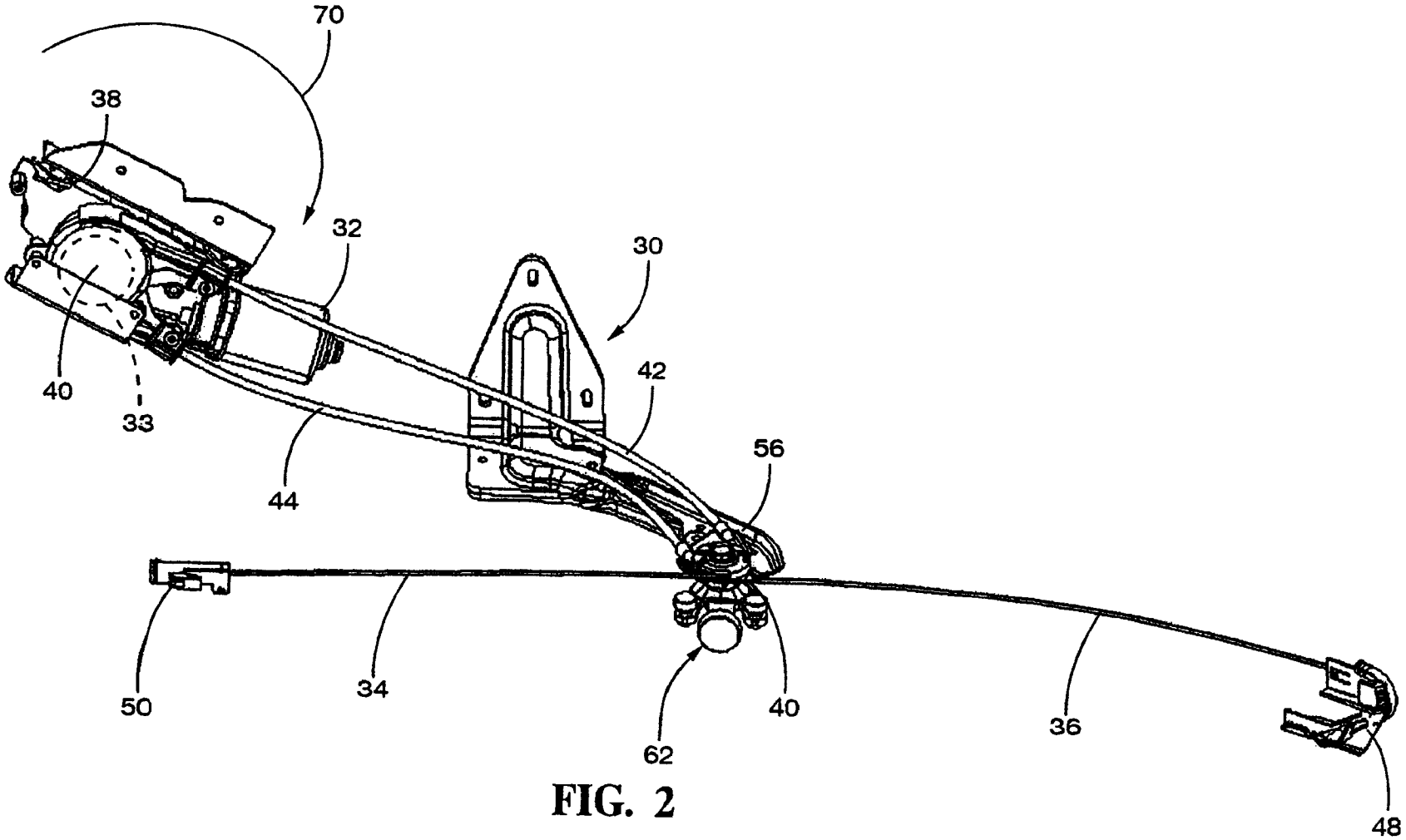
FIG. 2 is an in-door view of a power sliding door assembly constructed in accordance with an exemplary embodiment of the present invention.
Figure 3:
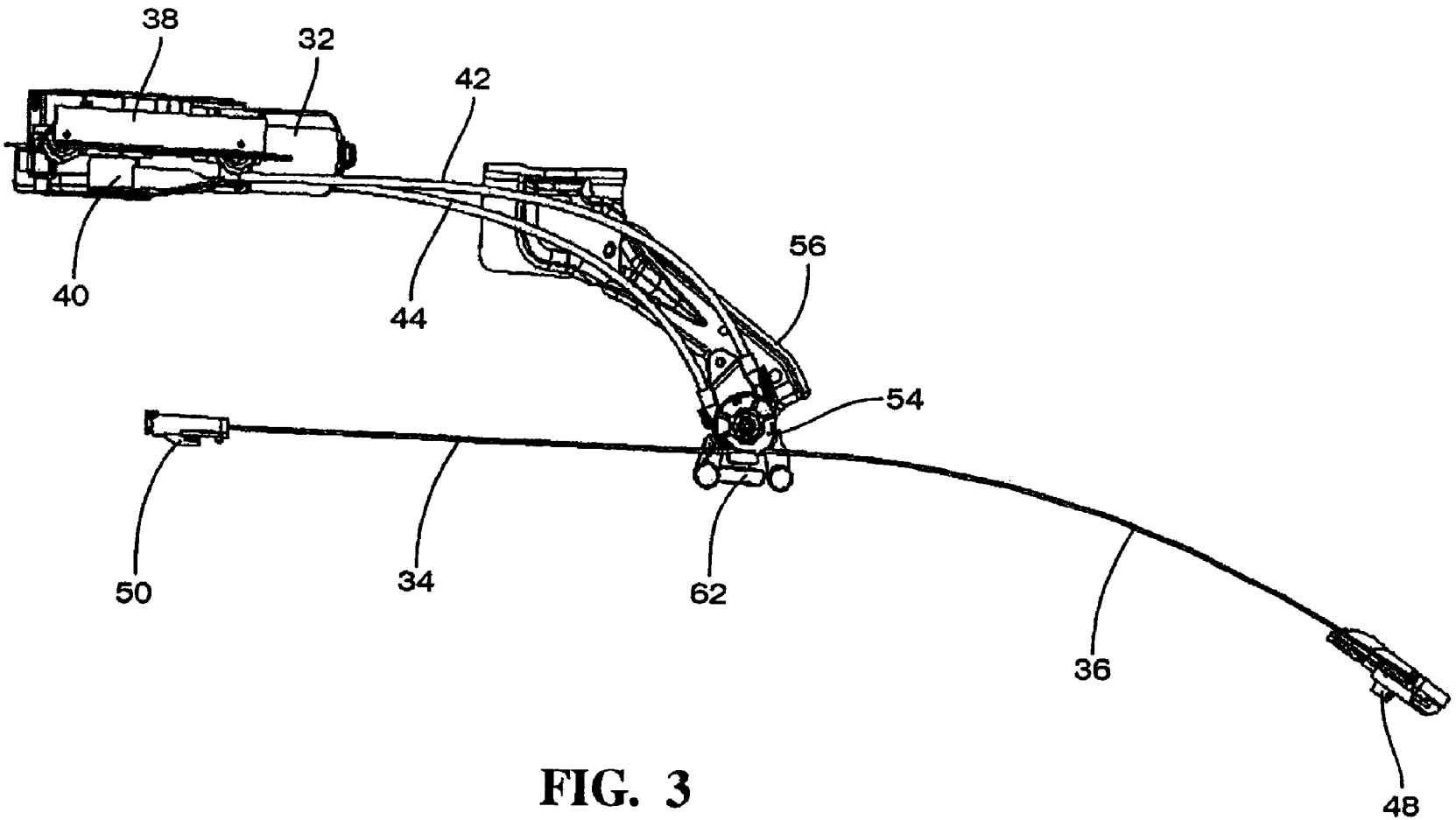
FIG. 3 is an in-door top view of a power sliding door assembly constructed in accordance with an exemplary embodiment of the present invention.
Figure 4:
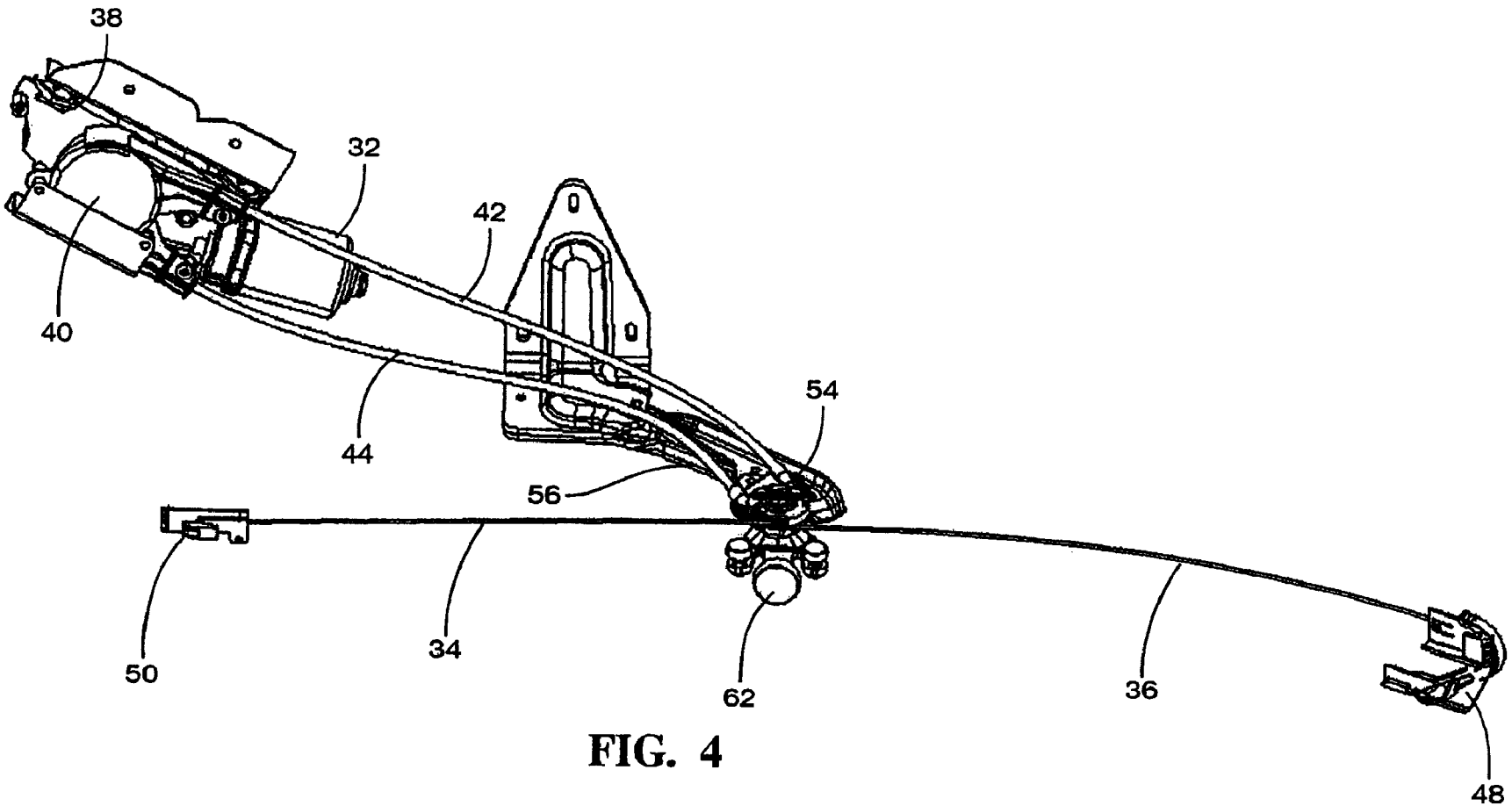
FIG. 4 is an in-door side view of a power sliding door assembly constructed in accordance with an exemplary embodiment of the present invention.
Figure 5:
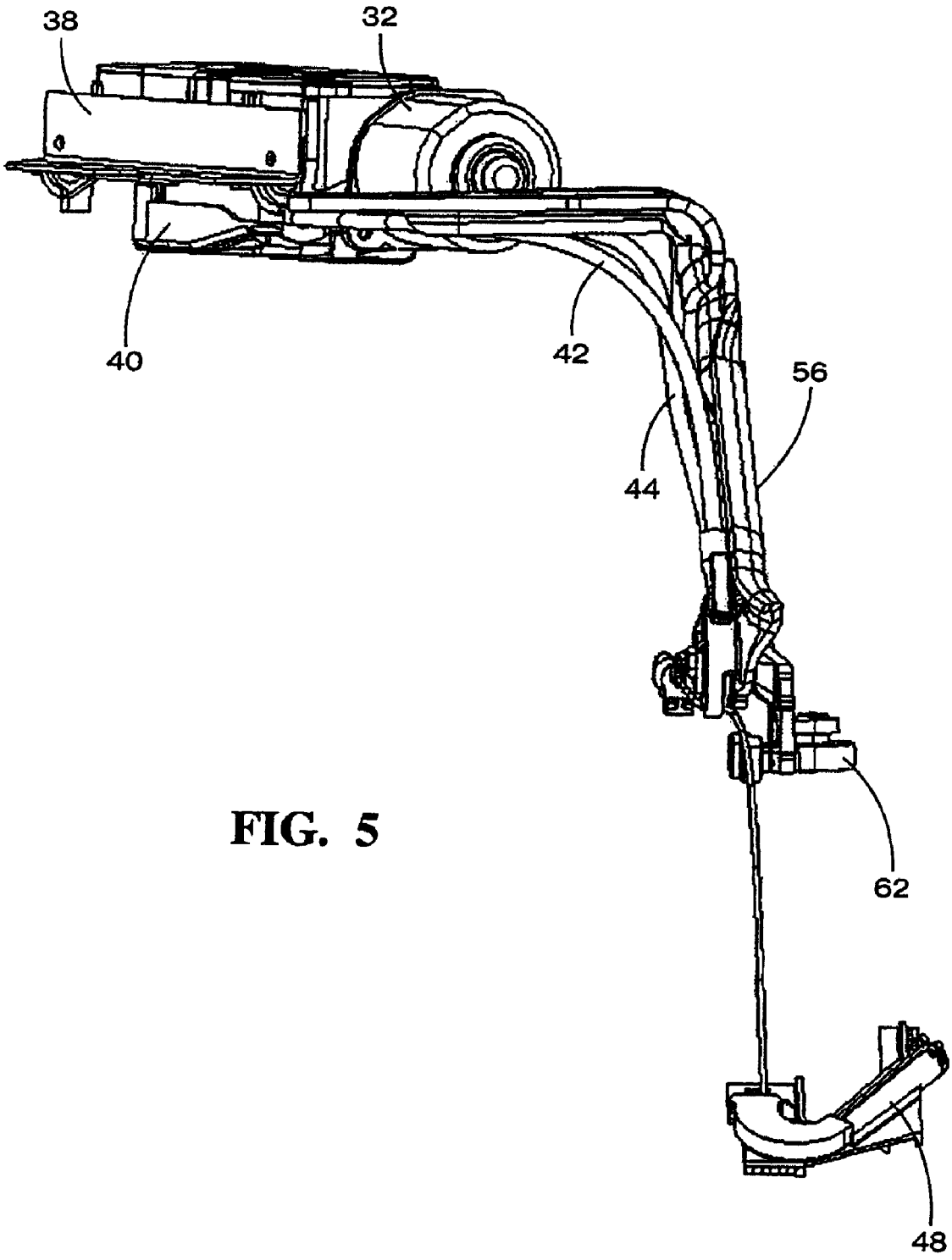
FIG. 5 is an in-door front view of a power sliding door assembly constructed in accordance with an exemplary embodiment of the present invention.
Figure 6:
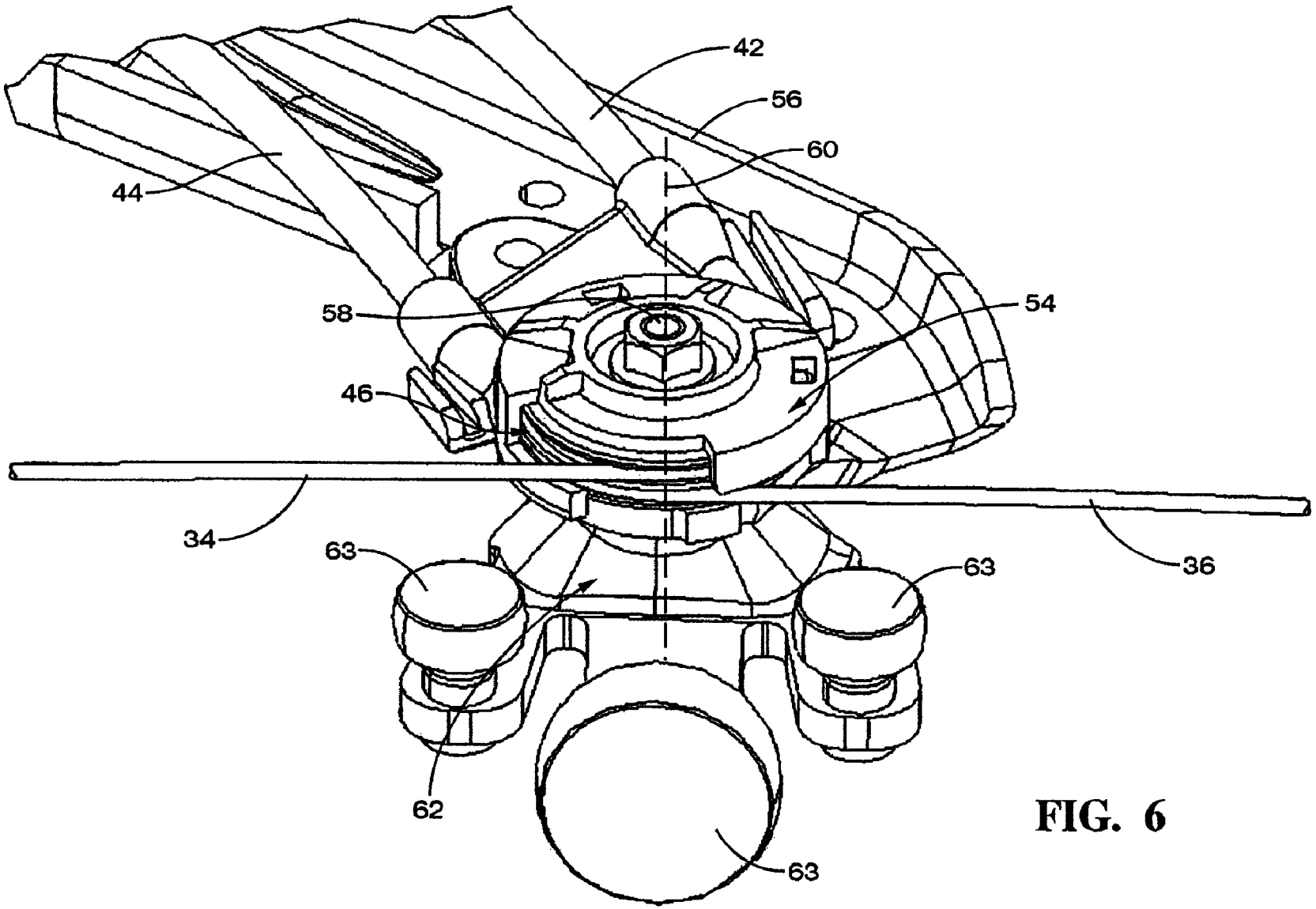
FIG. 6 is an enlarged view of a portion of a power sliding door assembly constructed in accordance with an exemplary embodiment of the present invention.
Figure 7:
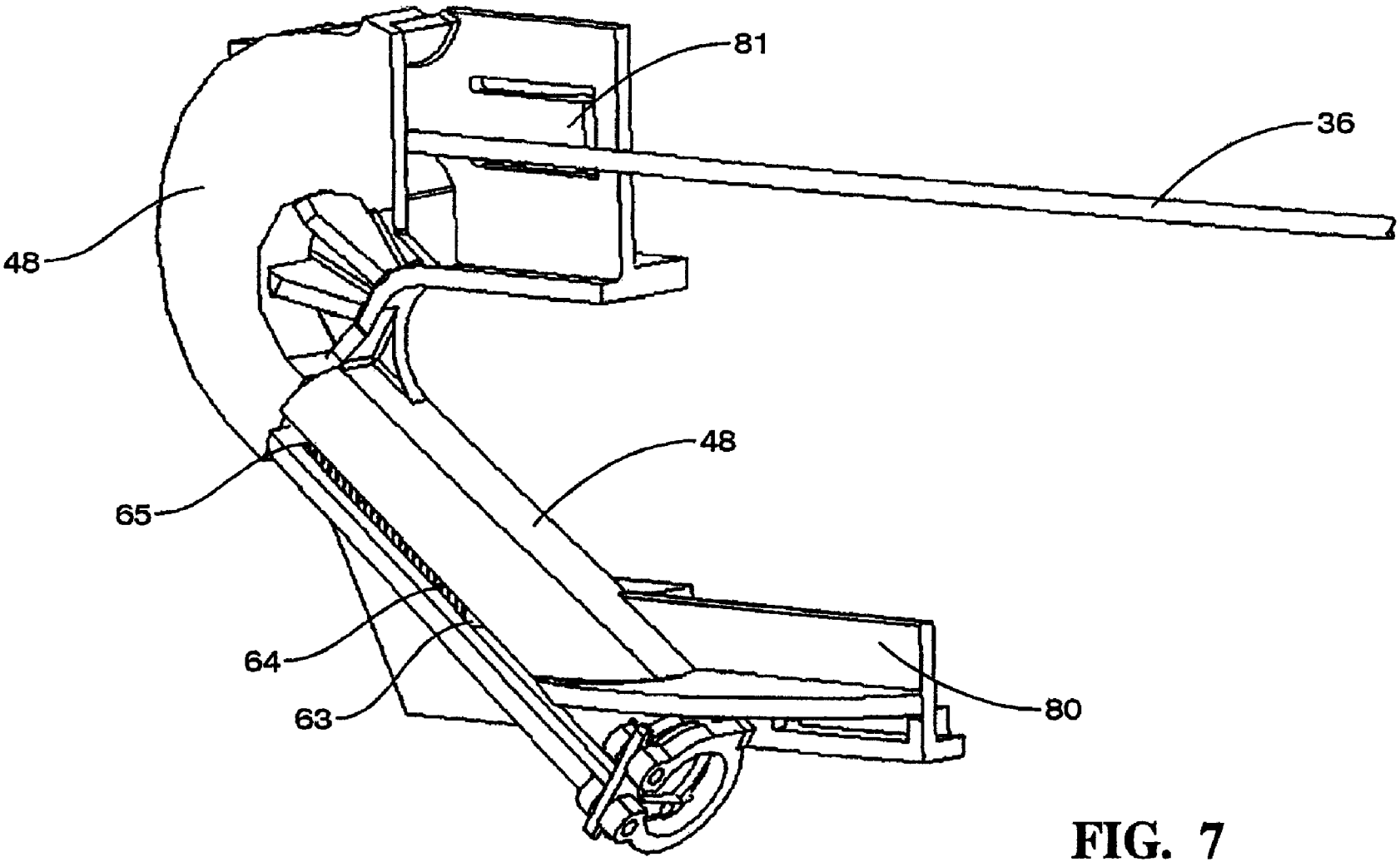
FIG. 7 is a perspective view of a forward cable retainer and tensioner for use in exemplary embodiments of the present invention.
Figure 8:
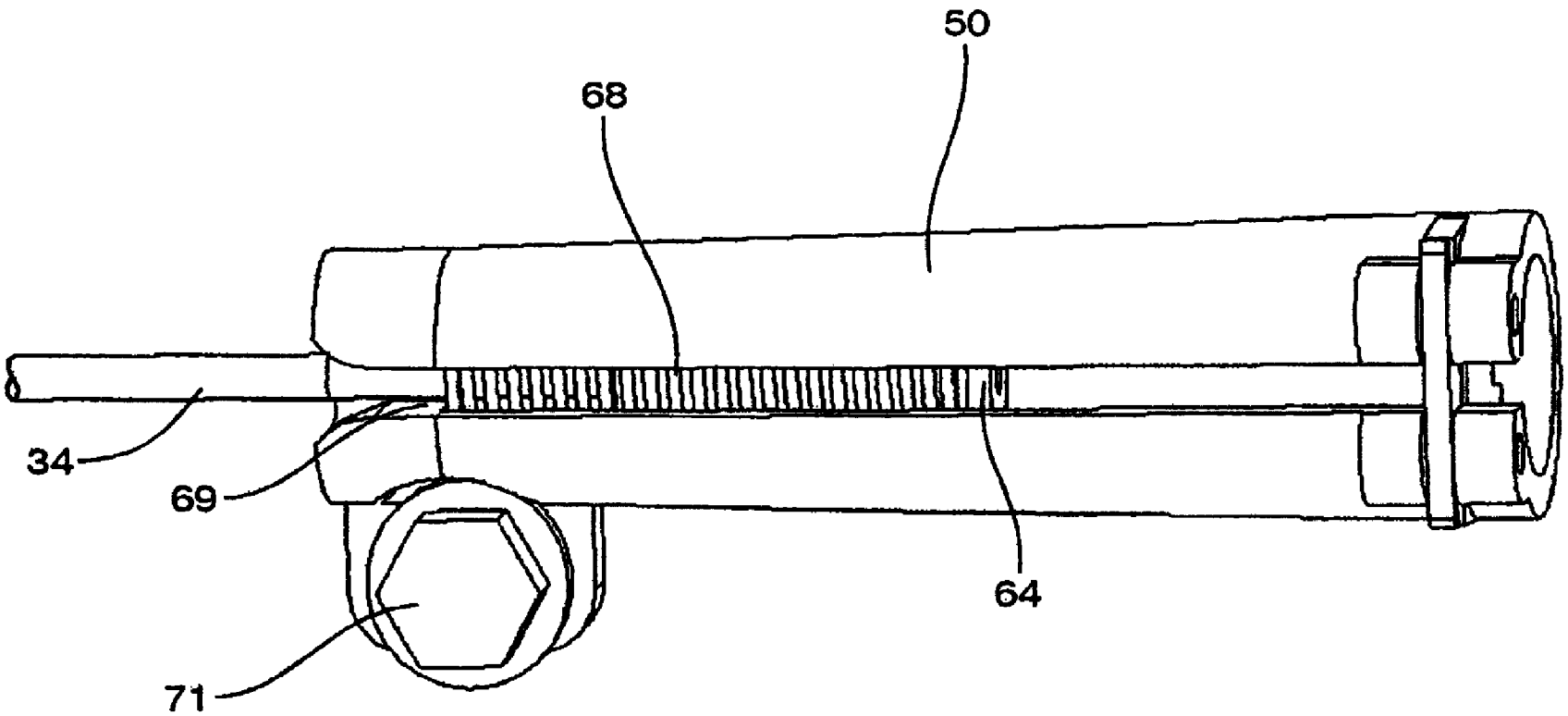
FIG. 8 is a perspective view of a rear cable retainer and tensioner for use in exemplary embodiments of the present invention.
Figure 9:
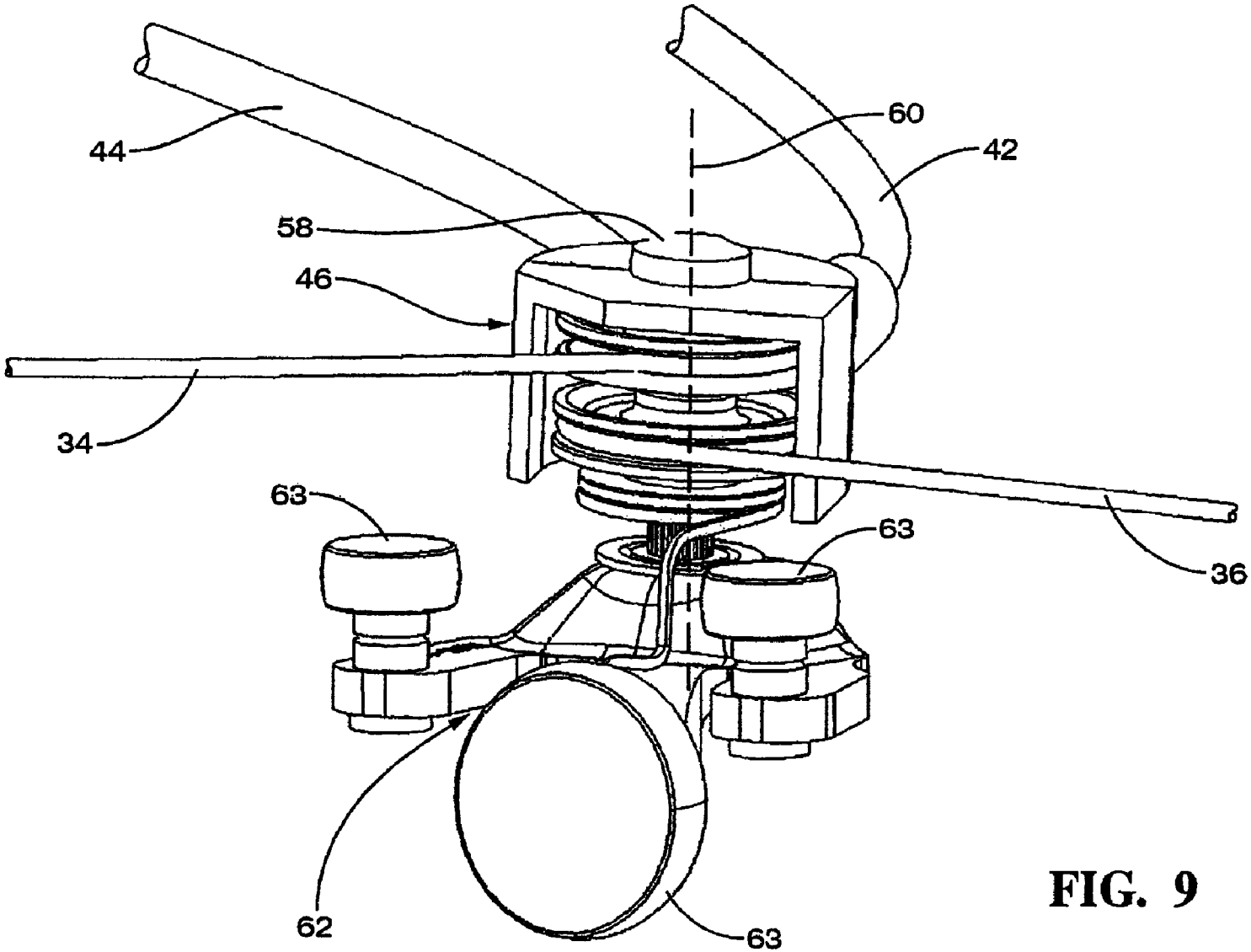
FIG. 9 is an enlarged view of a portion of a power sliding door assembly constructed in accordance with an exemplary embodiment of the present invention.

Referring now to FIG. 2, an in-door view of a power sliding door assembly 30 constructed in accordance with an exemplary embodiment of the present invention is illustrated. Power sliding door assembly 30 and portions of its cable and cable conduits are also illustrated schematically in FIG. 1 with dashed lines. FIG. 2 represents a view of the assembly as viewed from the inside of the vehicle. It is noted that for purposes of clarity FIGS. 2-5 illustrate the power sliding door unit without illustrating the sliding door to which the unit is mounted and the vehicle to which the guide track is mounted.

Motor drive assembly or unit provides the necessary driving force for the sliding door. More particularly, the motor drive assembly provides the force for rotating a cable drum in order to effect the desired movement of the sliding door.

It is noted that a left handed drive assembly is illustrated in the Figures. However, exemplary embodiments of the present invention are contemplated for use with either a left hand or right hand side vehicle door opening.

Referring now to FIGS. 2-11, exemplary embodiments of the present invention will be discussed. Motor drive assembly includes a motor 32, which is typically a DC motor that provides a driving or rotational force to a cable drum 33 (illustrated by the dashed lines). The cable drum 22 provides a driving force to a pair of cables 34 and 36. Each cable 34 and 36 has one end secured to the cable drum and another end secured to opposite ends of a guide track, which, in accordance with exemplary embodiments of the present invention, is the lower guide track. However, it is understood that exemplary embodiments contemplate that the cables can be secured to other guide tracks, for example, the center guide track, the upper guide track, or combinations thereof. A lower guide track is illustrated in FIG. 1 and a lower guide track is also illustrated in U.S. patent application Ser. No. 10/798,733.

In an alternative exemplary embodiment, a single cable is used. The single cable is secured at one end, wrapped around the cable drum, wrapped around a pulley of a roller assembly, and is secured at another end to a fixed location such that rotation of the cable drum causes the roller assembly to slide along in the guide track. Movement of the roller assembly causes the sliding door to open and close. Here, the cable has a feature, fitting or a plurality of features and fittings configured to engage a complimentary feature or opening in the cable drum to provide engagement between the cable and the cable drum to cause movement of the roller assembly when the cable drum is rotated. In other words, rotation of the cable drum in either direction will cause a portion of the cable to be wrapped on the cable drum and a portion of the cable to be unwrapped or unfurled as the cable engages the cable drum (e.g., rotation of the cable drum causes movement of the roller assembly). In another alternative exemplary embodiment, more than two cables are used to open and close the sliding door.

In accordance with an exemplary embodiment and when a pair of cables are used, the cables wrap around two pulleys stacked upon each other (FIG. 9) or a single pulley (FIG. 6) having two pulley guiding surfaces axially aligned with each other and then the cables are attached to opposite ends of the lower track.

In accordance with an exemplary embodiment, motor 32 is operably coupled to a gear box housing 38, wherein a shaft of the motor is configured to provide a driving force to a gear reduction package (not shown) located within the housing. In accordance with an exemplary embodiment, the gear box housing also contains a clutching system (not shown) and an encoder package (not shown). One non-limiting exemplary embodiment of a gear reduction package, encoder and clutching system is found in U.S. patent application Ser. No. 11/400,250, filed Apr. 7, 2006, the contents of which are incorporated herein by reference thereto. The clutching system allows the motor to be drivingly coupled to the cable drum for powered operation as well as decoupling for manual or non-powered operation of the sliding door. In addition, the encoder provides speed, position and directional movement signals to a controller for operating the system.

As illustrated, the motor drive assembly further comprises a cable drum 33 and housing 40, which is secured to the gear box housing, wherein the output drum is functionally connected to an output side of the clutch within the gear housing.

Cables 34 and 36 are attached to the output drum via a fitting or end feature configured to engage the cable drum such that as one cable is wound onto the drum, the other is unwound from the drum. These cables are routed through conduits 42 and 44, around pulley 46, and ultimately terminate at cable tensioners 48 and 50. Conduits 42 and 44 provide a path from the cable drum to pulley 46, thus cables 34 and 36 are slidably received within conduits 42 and 44 and the same protect cables 34 and 36 from becoming worn or damaged.

The conduits are attached to the drum housing at one end and terminate at a pulley housing 54 at the other. Pulley housing rotatably receives pulley 46 therein or alternatively a pair of pulleys therein, while having openings for the cables to pass therethrough. The pulley housing mounts to a lower control arm 56 of the power sliding door. In accordance with an exemplary embodiment, pulley 46 is allowed to rotate on a shaft 58, which is on the same axis of a pivot point 60 between a lower roller assembly 62 and the lower control arm, which is pivotally secured to the roller assembly at one end and fixedly secured to the door at the other end. In other words, pivot point 60 is the point at which the lower control arm pivots about the roller assembly as the same slides within the lower guide track as the door is opened and closed. In one alternative embodiment, a portion of the shaft or stud pivotally mounting the lower control arm to the roller assembly also provides the shaft about which pulley 46 rotates. Similarly, and when two independent pulleys are used, the same are mounted on the same axis of the pivot point 60. However, the two pulleys are capable of independent rotation with respect to each other. In the single pulley embodiment and in yet another alternative, the single pulley may have two portions capable of rotational movement with respect to each other. In this embodiment, the two portions may be spring biased to provide a slight rotation in opposite directions with respect to the two portions.

In addition, since the lower guide track includes a curved portion to wrap around one of the pillars of the vehicle frame, it is necessary to allow the control arm to pivot as the door is opened and closed (e.g., traverses inwardly and outwardly as well as along the guide track).

Roller assembly 62 is configured to traverse or slide along in a lower guide track by engaging the same with a plurality of rollers 63.

In accordance with an exemplary embodiment, since pulley 46 is axially aligned with this pivot point, the offset distance between pulley 46 and the lower track is maintained. In other words, the amount of cable being wrapped up or wrapped off of the cable drum will, in essence, correspond to the distance the roller assembly travels along in the track of the guide rail. This is due to pulley 46 being mounted on the pivot point. Accordingly, since pulley 46 is axially aligned with this pivot point, only the tangency of the cables to the pulley changes as the door travels in the guide track and thus there is no need for slack in the system to accommodate travel along curved portions of the guide track.

In accordance with an exemplary embodiment, the cables exit pulley 46 in opposite directions. Cable 36 is routed and secured to the front cable tensioner 48 and a tensioning spring 64 is compressed between a cable end fitting 63 on cable 36 and an inner wall 65 of the front cable tensioner. This tensioning arrangement allows for slight build variations in the vehicle body and door build, wherein slack in the cable can be provided by applying a force to the cable to overcome a biasing force provided by the tensioning spring 64.

Similarly, cable 34 exits pulley 46 and is routed to the rear cable tensioner 50 and a tension spring 68 is compressed between a cable end fitting 67 and an inner wall 69 of the rear cable tensioner. Again, this tensioning arrangement also allows for slight build variations in the vehicle body and door build, wherein slack in the cable can be provided by applying a force to the cable to overcome a biasing force provided by the tensioning spring 68.

A non-limiting example of the operation of the power drive system will now be explained. In accordance with an exemplary embodiment, when the cable drum is driven in a clockwise direction (as facing the drum in FIG. 2 and as illustrated by arrow 70), cable 36 is effectively shortened by an amount equal to what is being wound onto the drum. The first motion of the drum and hence the first motion of cable 36 causes the tensioning spring 64 to fully compress. After this initial motion of the cable 36, further shortening of the cable causes the distance between pulley 46 and the forward tensioner 48 to become less. Since the pulley is rigidly mounted to the door via the lower control arm, the door is pulled forward as if climbing a rope.

In accordance with an exemplary embodiment, forward door motion (door closing) is completed with the aid of a power cinching latch.

When the cable drum is driven in the opposite direction (counterclockwise or opposite to the direction of arrow 70), cable 34 is shortened and motion in the rear direction (door opening) is facilitated.

A non-limiting example of the assembly or usage of the power drive system will now be explained. In accordance with an exemplary embodiment, motor 32, gear box housing 38, and cable drum 33 and housing 40 are mounted to the inside of the door-in-white inner panel of the vehicle via a bracket attached to the gear box housing. The pulley housing is attached to a pivot stud of the lower roller assembly with a threaded fastener.

The vehicle door is then trimmed out and made ready for assembly to the vehicle. Cables 34 and 36 and their associated cable tensioners 48 and 50 are temporarily attached to the vehicle door trim. The door sub assembly is then moved to the main vehicle assembly line where it is mounted and adjusted in the typical fashion.

Once the door is mounted (e.g., securement of the lower roller assembly and other roller assemblies), the cable tensioners are affixed to the lower roller channel of the vehicle frame. In accordance with an exemplary embodiment, cable tensioner 48 is configured to have features to engage the lower channel of the lower guide track and be guided along that channel using features 80 on the tensioner and on the lower channel. In one exemplary embodiment, the cable tensioner includes a locking tab 81 for engaging a respective opening on the guide track. When the self-guiding cable tensioner 48 is slid far enough forward (e.g., the desired mounting location), locking features drop into cutouts in the lower channel and the features will cause the same to be fixedly secured therein. The tensioner 48 is then pulled rearward, locking it into position and permanently affixing it to the lower channel.

Figure 10:
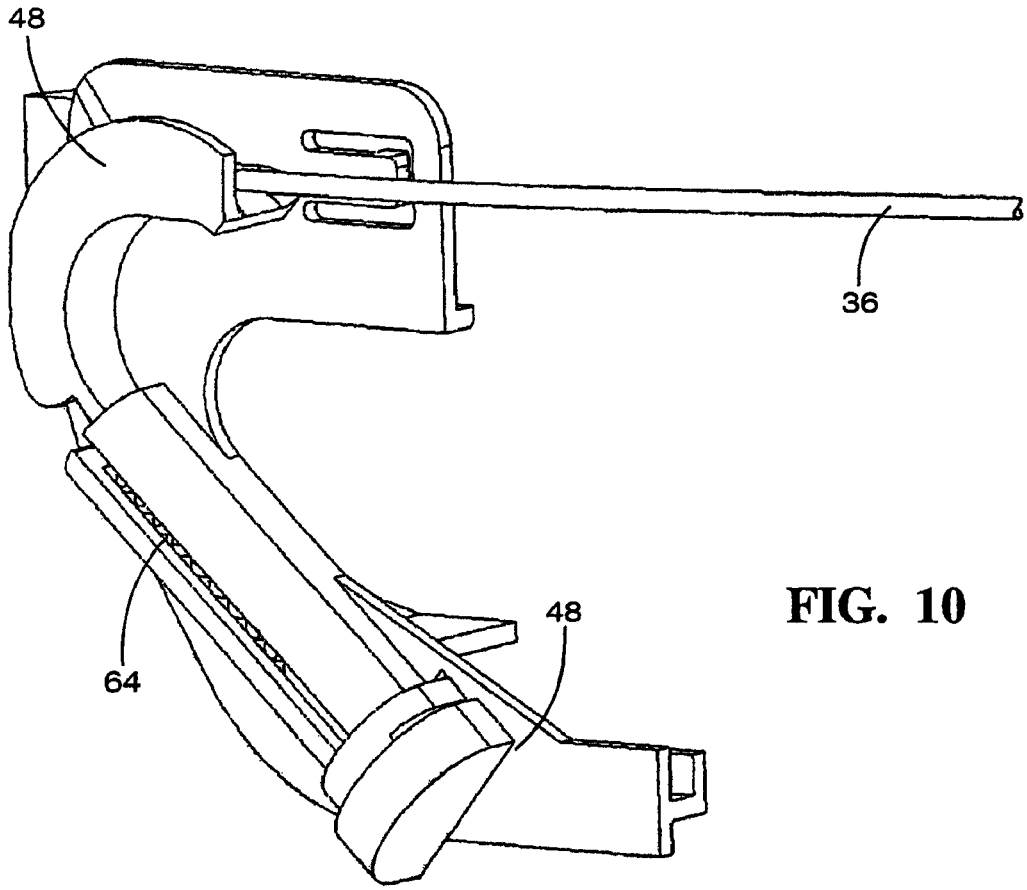
FIG. 10 is a perspective view of a forward cable retainer and tensioner for use in exemplary embodiments of the present invention.
Figure 11:
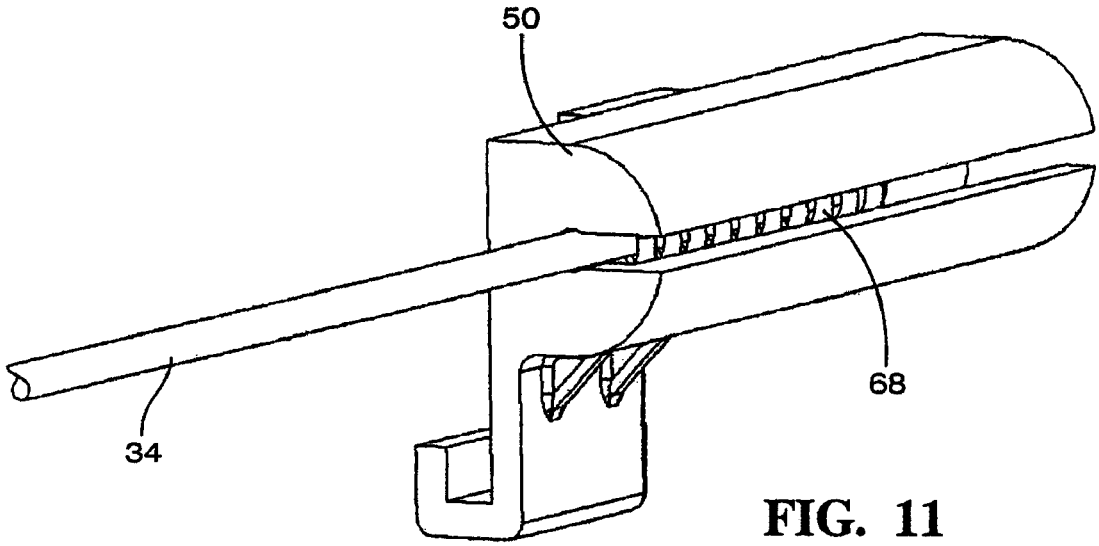
FIG. 11 is a perspective view of a rear cable retainer and tensioner for use in exemplary embodiments of the present invention.

In accordance with an exemplary embodiment, this same self-guiding and snap-in arrangement is used with the rear tensioner 50. Alternatively, the mounting of the rear tensioner is supplemented through the use of a mounting bolt 71 or any other equivalent securement means. Thus, with two simple attachments, the mechanical portion of the power sliding door system is attached to the vehicle. FIGS. 10 and 11 illustrate alternative embodiments of cable tensioners 48 and 50, wherein different configurations or features are provided for engaging the guide track.

In accordance with an exemplary embodiment and because the pulley housing is connected to the power component of the drive assembly (e.g., motor 32, gear train housing 38 and cable drum housing 40 via conduits 42 and 44), the power component can be mounted in numerous locations and orientations within the door.

In addition, the cables 34 and 36 only move relative to the lower channel while the tensioning springs 64 and 68 are being compressed. During the vast majority of the travel, the cables 34 and 36 do not move relative to the lower channel and, because of this, the sliding friction of the cable on the channel is largely eliminated, thereby reducing necessary user applied forces to open and close the door in a manual mode. The elimination of relative motion between the cables and the lower channel will also improve the durability of the system.

Locating the system at the lower guide channel also improves the appearance of the system since cables are only visible when viewed from a position at or below the rocker panel.

In accordance with an exemplary embodiment, the power drive assembly is mounted in the vehicle door and provides an apparatus for moving the sliding door via a cable system secured to the lower guide track, wherein the method of routing the cables reduces friction, wearability and required forces, as well as provides a quick and easy assembly sequence.

In order to operate the power sliding door of the vehicle it is contemplated that a sensing system will be installed in the vehicle such that signals received will cause the motor drive unit or assembly to open or close the door. The sensing system will provide the necessary signals to a control module or microprocessor having an algorithm for executing commands pursuant to signals received from the sensors. An example of a sensor and controller arrangement can be found in U.S. Pat. Nos. 5,263,762; 5,350,986; 5,396,158; 5,434,487; and 6,247,373, the contents of which are incorporated herein by reference thereto. It is, of course, understood that the aforementioned U.S. patents merely provide examples of sensor and controller arrangements capable of being used with the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A vehicle and sliding door assembly comprising:

a vehicle;

a guide track coupled to the vehicle;

a sliding door coupled to the guide track;

a power drive unit for providing a rotational force to rotate a cable drum of the vehicle and sliding door assembly, the power drive unit mounted within the sliding door;

a pair of cables each having one end secured to the cable drum and another end secured to the guide track;

a roller assembly slidably engaged to the guide track;

an arm fixedly secured to the sliding door to inhibit relative movement between the arm and the sliding door, the arm pivotally mounted to the roller assembly at a pivot point; and a pulley rotationally mounted to the roller assembly, the axis of rotation of the pulley being aligned with the pivot point, wherein each of the pair of cables engages the pulley in opposite directions as the cable drum rotates and the roller assembly slides along the guide track as the cable drum rotates, wherein movement of the roller assembly causes movement of the sliding door.

2. The drive assembly as in claim 1, wherein a pair of cable conduits are provided for the pair of cables, the pair of conduits extending from the power drive unit to a housing of the pulley.

3. The drive assembly as in claim 2, further comprising a forward cable tensioner and a rearward cable tensioner each being configured to engage the guide track and secure a respective one of the pair of cables to the guide track.

4. The drive assembly as in claim 2 wherein the guide track is a lower guide track of the vehicle.

5. The drive assembly as in claim 1, further comprising a forward cable tensioner and a rearward cable tensioner each being configured to engage the guide track and secure a respective one of the pair of cables to the guide track.

6. The drive assembly as in claim 1, wherein the guide track is a lower guide track of the vehicle and the pulley is a pair of pulleys each independently and rotationally mounted to the roller assembly, the axis of rotation of the pair of pulleys being aligned with the pivot point, and wherein one of the pair of cables engages one of the pair of pulleys while the other one of the pair of cables engages the other one of the pair of pulleys.

7. The drive assembly as in claim 1, wherein the pulley is a single pulley having a pair of channels engaging the pair of cables.

8. A sliding door assembly for a vehicle, the vehicle having a guide track, the sliding door assembly comprising:

a sliding door;

a power drive unit for providing a rotational force to rotate a cable drum of the drive assembly, the power drive unit mounted within the sliding door;

a cable having one end configured to be secured the guide track and another end configured to be secured to the guide track;

a roller assembly configured to slidably engage the guide track;

an arm fixedly secured to the sliding door to inhibit relative movement between the arm and the sliding door, the arm pivotally mounted to the roller assembly at a pivot point; and a pulley rotationally mounted to the roller assembly, the axis of rotation of the pulley being aligned with the pivot point, wherein the cable engages the pulley in opposite directions as the cable drum rotates and the roller assembly slides along the guide track as the cable drum rotates, wherein movement of the roller assembly causes movement of the sliding door.

9. The drive assembly as in claim 8, wherein a pair of cable conduits are provided for the cable, the pair of conduits extending from the power drive unit to a housing of the pulley.

10. The drive assembly as in claim 9, further comprising a forward cable tensioner and a rearward cable tensioner each being configured to engage the guide track and secure a respective end of the cable to the guide track.

11. The drive assembly as in claim 9, wherein the guide track is a lower guide track of the vehicle.

12. The drive assembly as in claim 8, further comprising a forward cable tensioner and a rearward cable tensioner each being configured to engage the guide track and secure a respective end of the cable to the guide track.

13. The drive assembly as in claim 8, wherein the guide track is a lower guide track of the vehicle.

14. The drive assembly as in claim 8, wherein the pulley is a single pulley having a pair of channels engaging portions of the cable.

* * * * *